US009570251B2

(12) United States Patent
Weaver et al.

(10) Patent No.: US 9,570,251 B2
(45) Date of Patent: Feb. 14, 2017

(54) ELECTRICAL CIRCUIT BREAKER SAFETY SYSTEM

(71) Applicant: The Boeing Company, Seal Beach, CA (US)

(72) Inventors: Donald C. Weaver, Marysville, WA (US); Robert D. Dixon, Everett, WA (US); James D. Mitchell, Everett, WA (US)

(73) Assignee: THE BOEING COMPANY, Chicago, IL (US)

( * ) Notice: Subject to any disclaimer, the term of this patent is extended or adjusted under 35 U.S.C. 154(b) by 143 days.

(21) Appl. No.: 14/487,495

(22) Filed: Sep. 16, 2014

(65) Prior Publication Data

US 2016/0079009 A1 Mar. 17, 2016

(51) Int. Cl.
*H01H 3/20* (2006.01)
*H01H 9/28* (2006.01)

(52) U.S. Cl.
CPC ..... *H01H 9/286* (2013.01); *H01H 9/28* (2013.01)

(58) Field of Classification Search
CPC ..... H01H 9/286
USPC ..... 200/43.11, 43.14–43.16, 43.19, 43.21
See application file for complete search history.

(56) References Cited

U.S. PATENT DOCUMENTS 5,207,315 A * 5/1993 Benda ..... H01H 9/283 200/43.11
6,580,041 B1 * 6/2003 Ransopher ..... H01H 9/286 200/43.11
2015/0083555 A1 * 3/2015 Nickels ..... H01H 9/283 200/43.15

* cited by examiner

*Primary Examiner* — Renee Luebke
*Assistant Examiner* — Lheiren Mae A Caroc
(74) *Attorney, Agent, or Firm* — Francisco A. Rubio-Campos; Apogee Law Group P.C.

(57) ABSTRACT

A system is provided for preventing a push-pull circuit breaker from being inadvertently depressed. The system may include a clip member having a generally C-shaped collar defining a cylindrical recess therein. The clip member is configured to resiliently expand to be positioned over and receive a cylindrical portion of the circuit breaker knob in a manner that prevents the circuit breaker knob from being depressed to close the circuit breaker. The system further includes first and second tabs depending from ends of the clip member. A cable tie may be positioned through openings formed in the first and second tabs to secure the first and second ends to each other, thereby locking the clip member in position on the push-pull circuit breaker knob and preventing the circuit breaker knob from being depressed.

16 Claims, 6 Drawing Sheets

ELECTRICAL CIRCUIT BREAKER SAFETY SYSTEM

BACKGROUND

1. Technical Field

The present disclosure generally relates to safety devices for electrical circuit breakers and, more particularly, to a system and device for preventing the inadvertent engagement of a push-pull circuit-breaker.

2. Background of the Invention

The U.S. Occupational Safety and Health Administrations' ("OSHA") Control of Hazardous Energy (Lock-Out/Tag-Out) ("LOTO") standards, Title 29 Code of Federal Regulations (CFR) Parts 1910.147, 1019.333, require employees that perform work inside of an electrical panel to de-energize live parts of a circuit to which an employee may be exposed before the employee works on or near them. This standard applies to employees that service machines and equipment in which an unexpected energization or start-up of the machines or equipment, or release of stored energy, could harm the employee.

Under the standard, a person servicing, for example, electrically-powered machines or equipment is required to disengage a circuit breaker coupled to the component and apply a locking or "lock-out" device to the breaker to prevent the circuit breaker from inadvertently engaging while the component is being serviced. In addition to being de-energized and locked-out, such equipment or and circuits must be tagged at all points of work where the equipment or circuits can be energized. Such tags must be attached to the inoperative equipment and circuits such that the tags may be seen in plain sight. The tags must also identify the equipment or circuits currently being serviced. Further, in order to comply with LOTO standards, the lock-out device must not be capable of being removed from the circuit breaker by hand—the lock-out device must be removed by some sort of equipment or tool.

In applying the LOTO standards to, for example, circuit panels 100 in aircraft structures, push-pull actuated circuit breakers 102 commonly used in these types of applications must be disengaged from the circuit panel 100 before a technician may service equipment or circuits coupled to the breaker 102. Once the circuit breaker 102 is disengaged, a lock-out device 104 must be secured to the circuit breaker knob to prevent the circuit breaker from being depressed. One example of a commonly used lock-out device is the multipart Skykit® system (which includes the Skylox®, Skyvault®, Skytag®, and Skyclip®), sold by Kascar, LLC, One Kascar Plaza, Greenville, S.C. 29605. Such lock-out devices, while effective, carry a host of undesirable characteristics.

First, as best shown in FIG. 1*a*, existing lock-out devices 104 are bulky and often protrude out from the circuit panel 100. In some instances, the lock-out devices 104 may protrude from the circuit panel 100 more than an inch or so. This protrusion reduces the useable workspace of a technician because, as shown in FIG. 1*b*, the passageways in electrical bays ("E-bay") of aircraft structures are very tight and, as such, technicians 106 frequently snag or bump into the lock-out device 104 while passing through the E-bay. Because circuit breaker knobs are not intended to be loaded, only to be pushed in or pulled out, the breaker knobs 102 upon which the lock-out devices 104 are applied may be sheared or snapped-off when the lock-out devices 104 are inadvertently engaged by a technician 106 passing through the E-bay.

The replacement of one damaged circuit breaker may cost several thousand dollars. Thus, the replacement of several damaged breakers during the service or maintenance of an aircraft structure can be very costly.

A second characteristic of existing lock-out devices is that they generally comprise several parts. For example, the commonly used Skykit® system comprises six separate parts: the Skylox® (which comprises two half-shells and an O-ring), the Skyvault®, the Skytag®, and the Skyclip®. In the aviation industry, in particular, objects laying around an aircraft that are not part of the operation are referred to as FOD. FOD, which stand for foreign object debris, refers to any substance, debris or article alien to a vehicle or system which would potentially cause damage. FOD often migrate around aircraft structures and the use of existing multi-part lock-out devices increases FOD risk. As such, there is a need for a low profile lock-out system comprising a minimal number of parts.

SUMMARY

A system is provided for preventing a push-pull circuit breaker from being inadvertently depressed. In one example, the system may include a clip member having a generally C-shaped collar defining a cylindrical recess therein. The clip member is configured to resiliently expand to be positioned over and receive a cylindrical portion of the circuit breaker knob. The system further includes first and second tabs depending from ends of the clip member. The first and second tabs form a restricted opening for which the cylindrical portion of the circuit breaker knob may be snapped into the recess. The first and second tabs have openings formed therethrough. A retainer, for example a cable tie may be positioned through the openings in the first and second tabs and fastened in a loop to secure the first and second tabs to each other in a manner that prohibits the first and second tabs from being urged apart and the clip member from expanding sufficiently to permit removal of the clip member from the circuit breaker knob, thereby locking the clip member in position on the push-pull circuit breaker knob and preventing the circuit breaker knob from being depressed.

A clip configured to be removably received over a cylindrical portion of a push-pull circuit breaker knob is also provided. The clip includes a substantially C-shaped collar defining a cylindrical recess therein. The collar is configured to resiliently expand to be positioned over and receive the cylindrical portion of the circuit breaker knob in a manner that prevents the circuit breaker knob from being depressed to close the circuit breaker. The clip further includes first and second tabs that depend from ends of the collar. The first and second tabs form a restricted opening for which the cylindrical portion of the circuit breaker knob may be snapped into the recess. The first and second tabs have openings formed therethrough.

A method for preventing actuation of a push-pull circuit breaker knob is further provided. The method includes disengaging the circuit break knob from its corresponding circuit breaker panel and applying a clip member about an actuating cylindrical portion of the circuit breaker knob. The clip member includes a generally C-shaped collar defining a cylindrical recess therein and is configured to resiliently expand to be positioned over and receive the cylindrical portion of the circuit breaker knob. The method further includes coupling a retainer to the clip member to secure the clip member to the cylindrical portion of the of the circuit breaker knob in a manner that prohibits the clip member from being forceably removed from circuit breaker knob.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

FIGS. 2-7 illustrate examples of a system 200 (see FIG. 4) for preventing a powered push-pull actuating circuit breaker from accidentally engaging during the inspection of a structure powered by a circuit. The system 200 includes a clip member 202 and a cable tie 406 (FIG. 4) for retaining the clip member 202 about a knob of the circuit breaker. The disclosed system may be useful in any field in which electrically powered structures are inspected and serviced by field technicians.

Figure 1A:
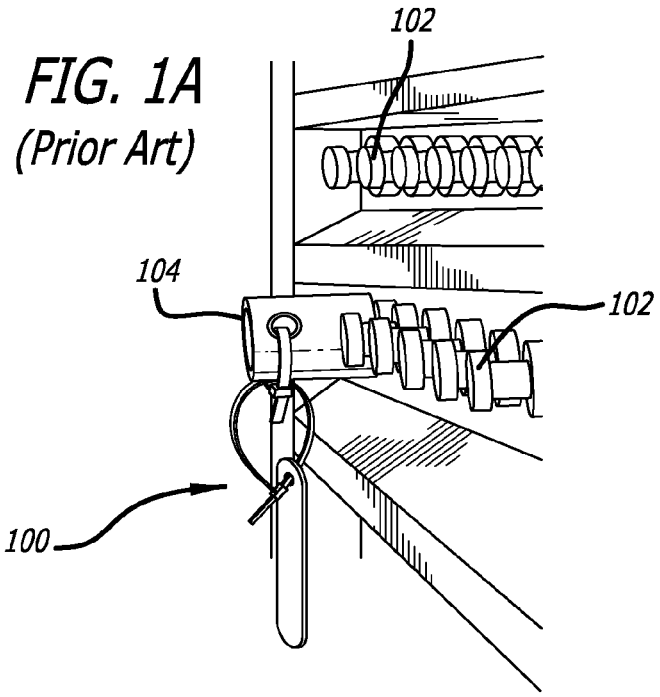
FIG. 1A (Prior Art)
FIGS. 1A-1B (Prior Art) are enlarged perspective views illustrating an existing lock-out device in use with push-pull circuit breaker.
Figure 1B:
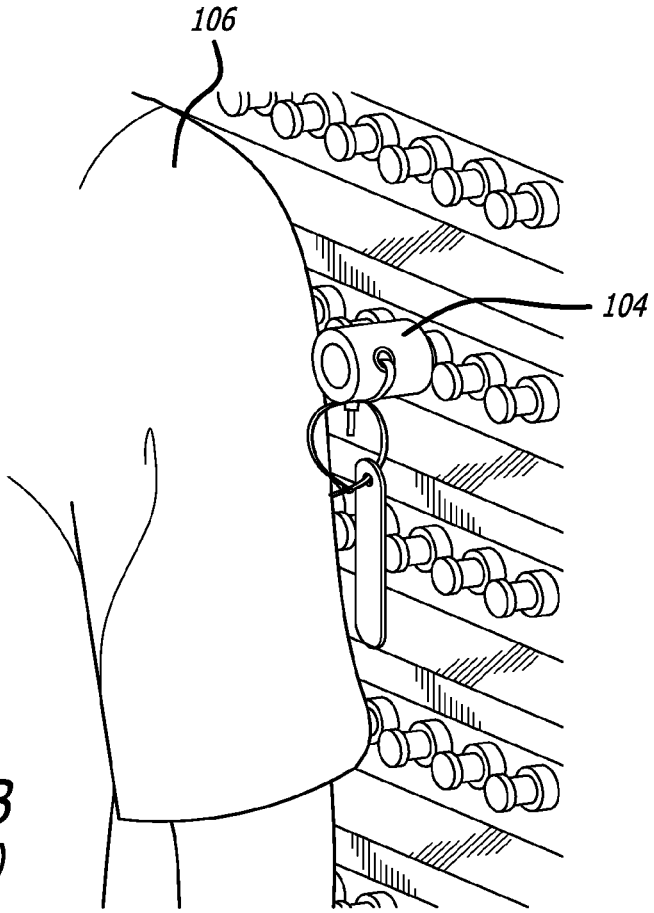
FIG. 1B (Prior Art)
Figure 2:
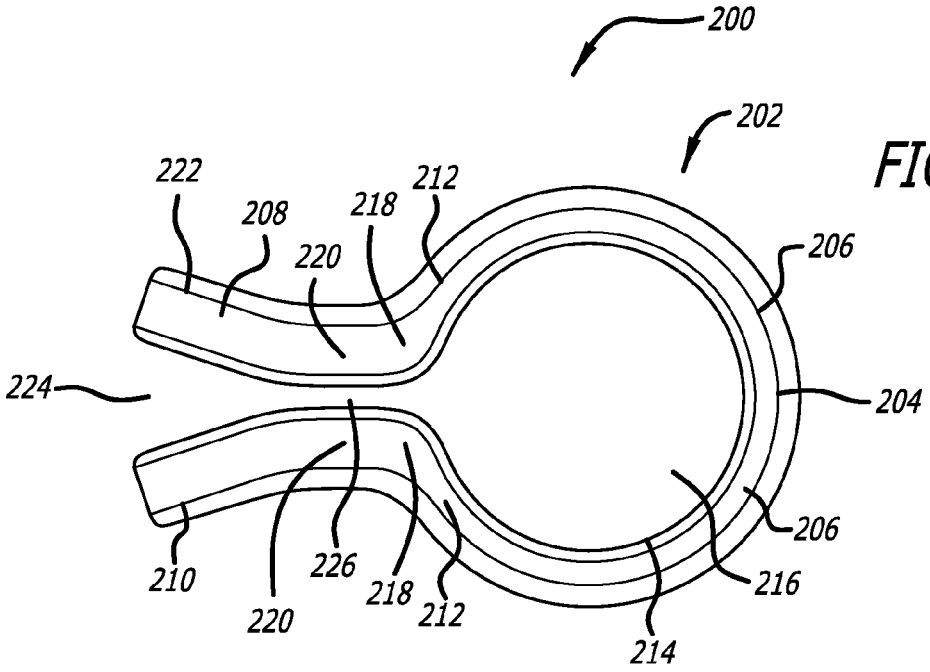
FIG. 2 is a top view of an example of a clip member of a system for preventing a push-pull actuating circuit breaker from being depressed, in accordance the present disclosure.

FIG. 2 is a top view illustrating one example of the clip member 202. The clip member 202 may include a c-shaped annual collar 204 having a thickness 206, and tabs 208, 210 extending from free ends 212 of the collar 204. The collar 204 includes an inner wall 214 defining a circular recess 216 therein. In some implementations, the collar 204 may have a thickness 206 of between 0.05 and 0.1 inches, and more preferably 0.06 inches and the inner wall 214 may be constructed to diametrical dimensions of approximately between ⅓ and ⅜ inches, or such other dimensions suitable to correspond to the dimensions of a push-pull circuit breaker knob.

The clip member 202 may be made from acrylonitrile-butadiene-styrene copolymer (ABS) plastic or any other material having similar pliant and electrically non-conductive properties. More specifically, the clip member 202 can be made of material that enables the collar 204 to flex outward as force is applied to the tabs 208, 210 apart to spread them apart, for example, when the tabs 208, 210 are engaged by the circuit breaker knob, as discussed in detail below. In certain implementations, the clip member 202 may comprise safety warning colors, such as red, to indicate to a technician that the circuit breaker knob about which the clip member 202 is secured is disengaged from the circuit breaker panel.

Each tab 208, 210 may form a substantially concave shape that includes a curved end 218 integrally formed with the opposite ends 212 of the collar 204, a substantially planar landing portion 220, and an angled free end 222 opposite the curved end 218. The free end 222 may be angled relative to the landing portion 220 to angular dimensions between, for example, approximately 10° to 45°. In this way, the opposing tabs 208, 210 may be identical in dimensions and shape such that the landing portions 220 of the tabs 208, 210 mate and are capable of bearing against one another.

The free ends 222 of the tabs 208, 210 cooperate to form a substantially V-shaped mouth 224 and restricted opening or throat 226 into which a stem of the circuit breaker knob may be snapped. The mouth 224 and throat 226 communicate with the recess 216 to provide a means for urging the tabs 208, 210 apart and guiding the circuit breaker knob into the recess 216. The tabs 208, 210 may be constructed to a thickness equal to or greater than the thickness of the collar 204 to provide greater structural strength against shearing forces as tabs 208, 210 are urged apart by the circuit breaker knob and, further, to ensure that the tabs 208, 210 are capable of engaging one another when the circuit breaker knob is installed within the recess 216. For instance, and by way of example only, the clip member 202 may be constructed with a collar thickness 206 of 0.6 inches and tab 208, 210 thicknesses of 0.08 inches.

Figure 3:
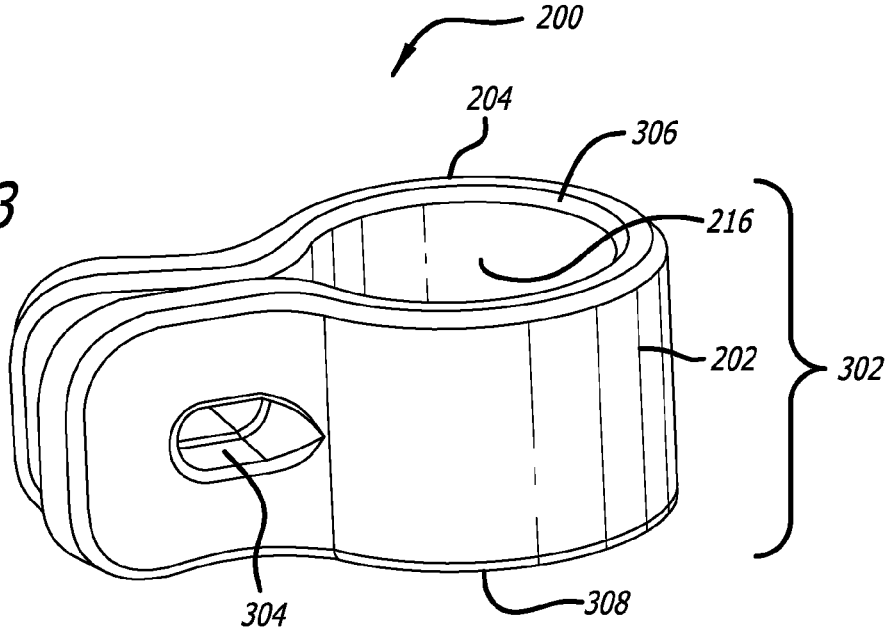
FIG. 3 is a perspective view of the clip member shown in FIG. 2.

FIG. 3 is a perspective view the clip member 202. As shown the collar 204, for example, may have a height 302 between ¼ and ⅓ inches. A suitable height 302 for enabling the collar 204 to fit between a head portion of the circuit breaker knob and a housing portion of the circuit breaker may be 0.30 inches. At any event, the collar 204 should be constructed to a height sufficient to prevent the circuit breaker knob from being depressed.

As further shown, each tab 208, 210 may include a slot 304 of suitable dimensions to pass a cable tie therethrough. In certain implementations, upper and lower surfaces 306, 308 of the collar 204 and the free ends 222 of the tabs 208, 210 may be chamfered or rounded to eliminate any sharp edges.

Figure 4A:
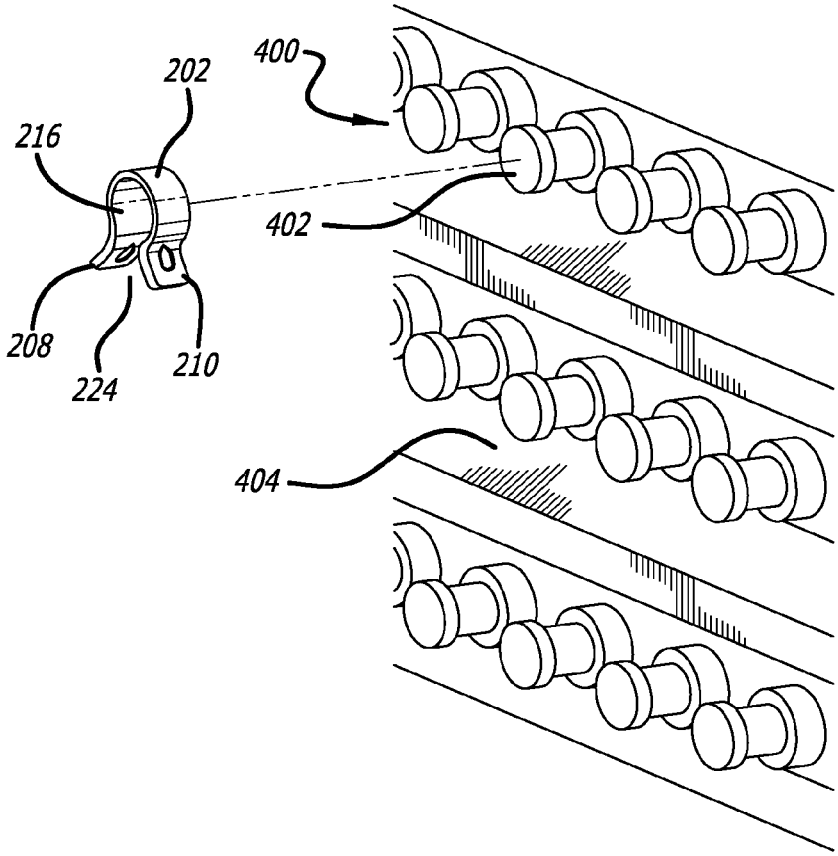
FIG. 4A is an enlarged perspective view illustrating how the clip member of FIG. 2 may be installed on a push-pull circuit breaker knob in accordance with the present disclosure.
Figure 4B:
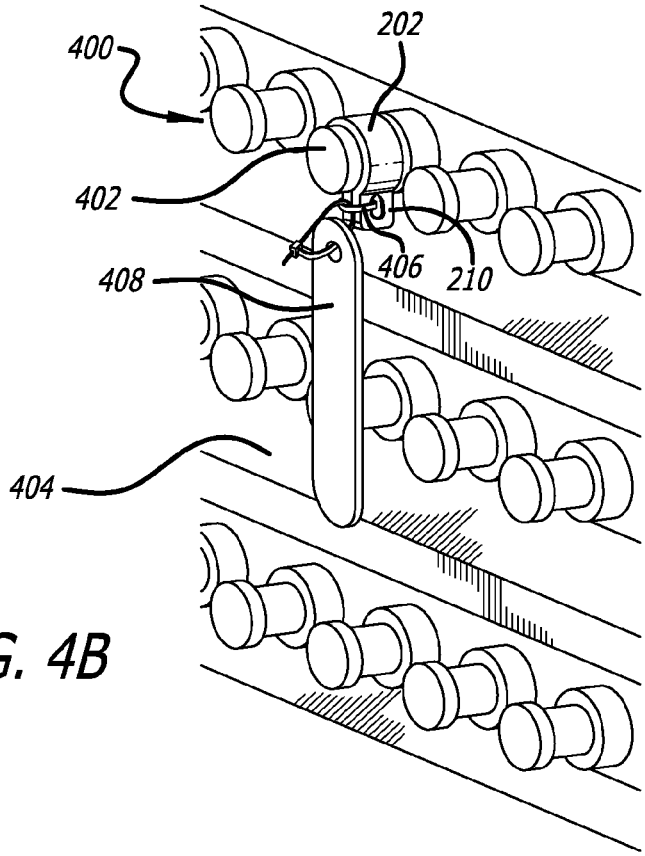
FIG. 4B is an enlarged perspective view of the clip member of FIG. 2 installed on a push-pull circuit breaker knob in accordance with the present disclosure.
Figure 5:
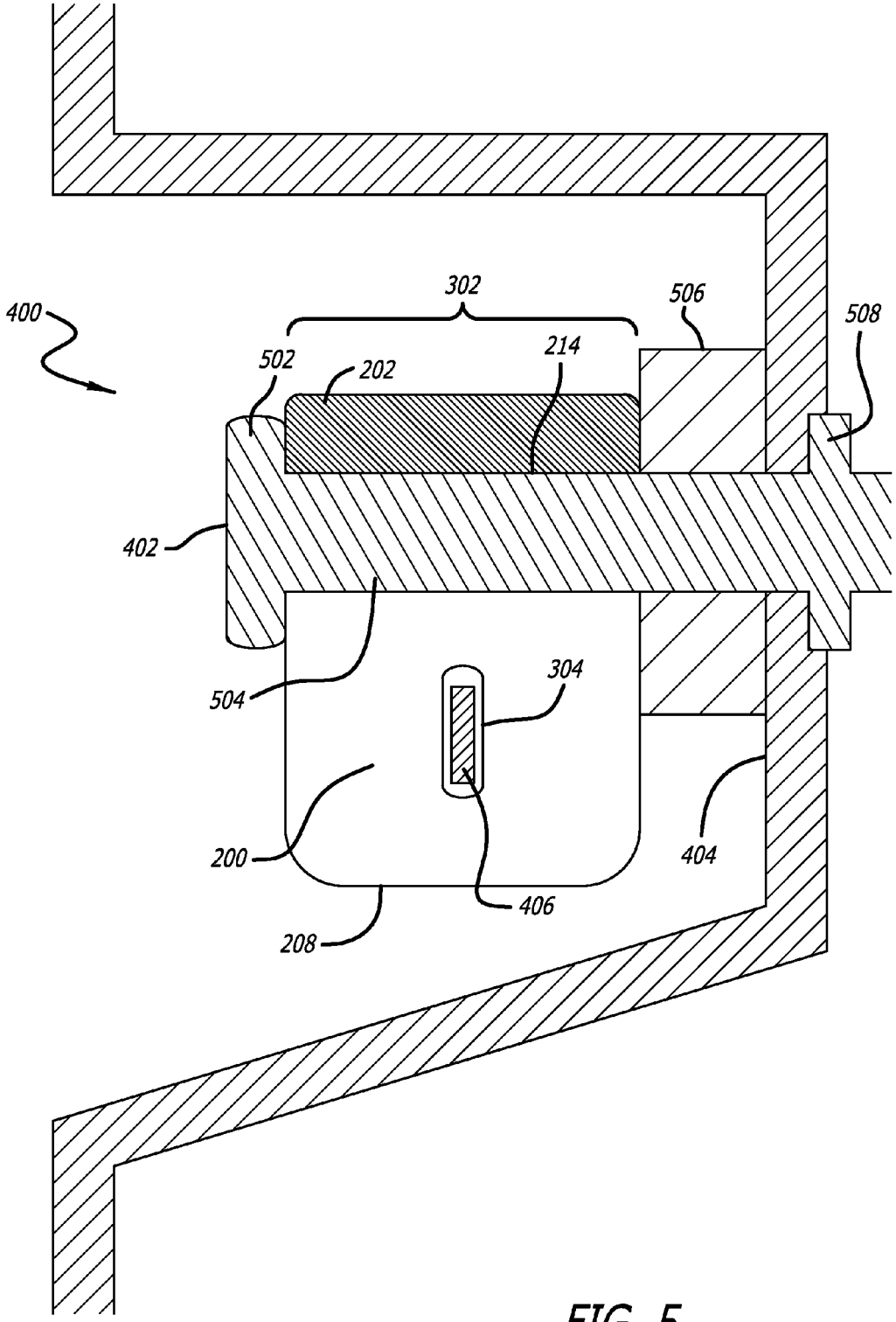
FIG. 5 is a side cross-sectional view of the clip member as shown in FIG. 4.

FIGS. 4A-4B are enlarged perspective views and FIG. 5 is a cross section view illustrating the installation of the clip member 202 on a knob 402 of a push-pull circuit breaker 400. As best shown in FIG. 5, each breaker 400 is mounted on a panel 404 so that the knob 402 projects from the panel 404 for actuation. The circuit breaker knob 402 includes a head portion 502 and a stem 504 that actuates into and out of an annular housing 506 coupled to the circuit breaker panel 404.

During installation of the clip member 202 over the breaker knob 402, the breaker knob 402 must be disengaged from the breaker panel 404 (i.e., the head portion 502 must be disengaged from the housing 506) so the clip member 202 may be manually snapped onto the stem 504 of the breaker knob 402. When the breaker knob 402 is disengaged from the breaker panel 404, the stem 504 is retained within breaker housing 506 by a stop 508. As shown in FIG. 4A, the tabs 208, 210 of the clip member 202 must be spread apart to allow the knob to be received in the recess 216 of the clip member 202, through the mouth 224.

Referring back to FIG. 5, when installed, the collar 204 is disposed between the head 502 and the breaker housing 506 to restrict the actuation of the breaker knob 402. The collar 204 may be constructed to a sufficient height 302 to prevent the breaker knob 402 from being depressed. For example, the collar 204 may be constructed to a height having an interference fit between the head 502 and the breaker housing 506.

Once the clip member 202 is snapped into place over the breaker knob 402, a self-locking cable tie 406, otherwise known as a panduit strap, is looped through the slots 304 of the tabs 208, 210 (shown also in FIG. 4B) and secured in a looped configuration to secure the restricted opening 226 (FIG. 2) and prevent tabs 208, 210 from being pried or urged apart and the clip member 202 from expanding sufficiently to permit removal of the clip member 202 from the circuit breaker knob 402. Thus, when force is applied to the head 502 to push the knob 402 into engagement, the collar 204, trapped between the head 502 and the breaker housing 506, prevents the knob 402 from moving. When the cable tie 406 is secured within the slots 304 of the tabs 208, 210, the only way the clip member 202 may be removed from the breaker knob 402 is by cutting the cable tie 406 with a cutting tool.

It is well understood that a push-pull circuit breaker only engages when the breaker knob 402 is pressed all the way into the breaker panel 404. Most push-pull circuit breakers have an indicator in the form of a white ring or strip that is striped about the stem of the knob. When a knob is disengaged (i.e., pulled out), the white ring indicates that the circuit breaker is open. So when the breaker 400 is open, power comes to the breaker 400, but it does not go through the breaker 400 to power the structure or device (not shown) electrically coupled to the breaker. It is not until the knob 402 (i.e., the head portion 502) is fully engaged with the breaker panel 404 (i.e., breaker housing 506) that the circuit breaker 400 is closed and electrical current is permitted to flow to the structure or device.

Under the LOTO standards, lock-out devices must be tagged with a serial number, for identification, and a warning decal must be attached to the device. Therefore, in certain implementations, as shown in FIG. 4B, a warning tag 408 with serial numbers may be coupled to the cable tie 406. In some implementations, the warning tag 408 may comprise an elongated (e.g., rectangular) shaped placard with safety colors, such as, for example, a solid red background with white lettering. The lettering may include the signal wording such as WARNING or DANGER, in addition to serial number(s) identifying the circuit breaker unit, or the structure or device coupled to the circuit breaker unit, and the person performing the lock and tag. In other implementations, the warning tag may be a paper tag embossed with appropriate safety information.

Figure 6:
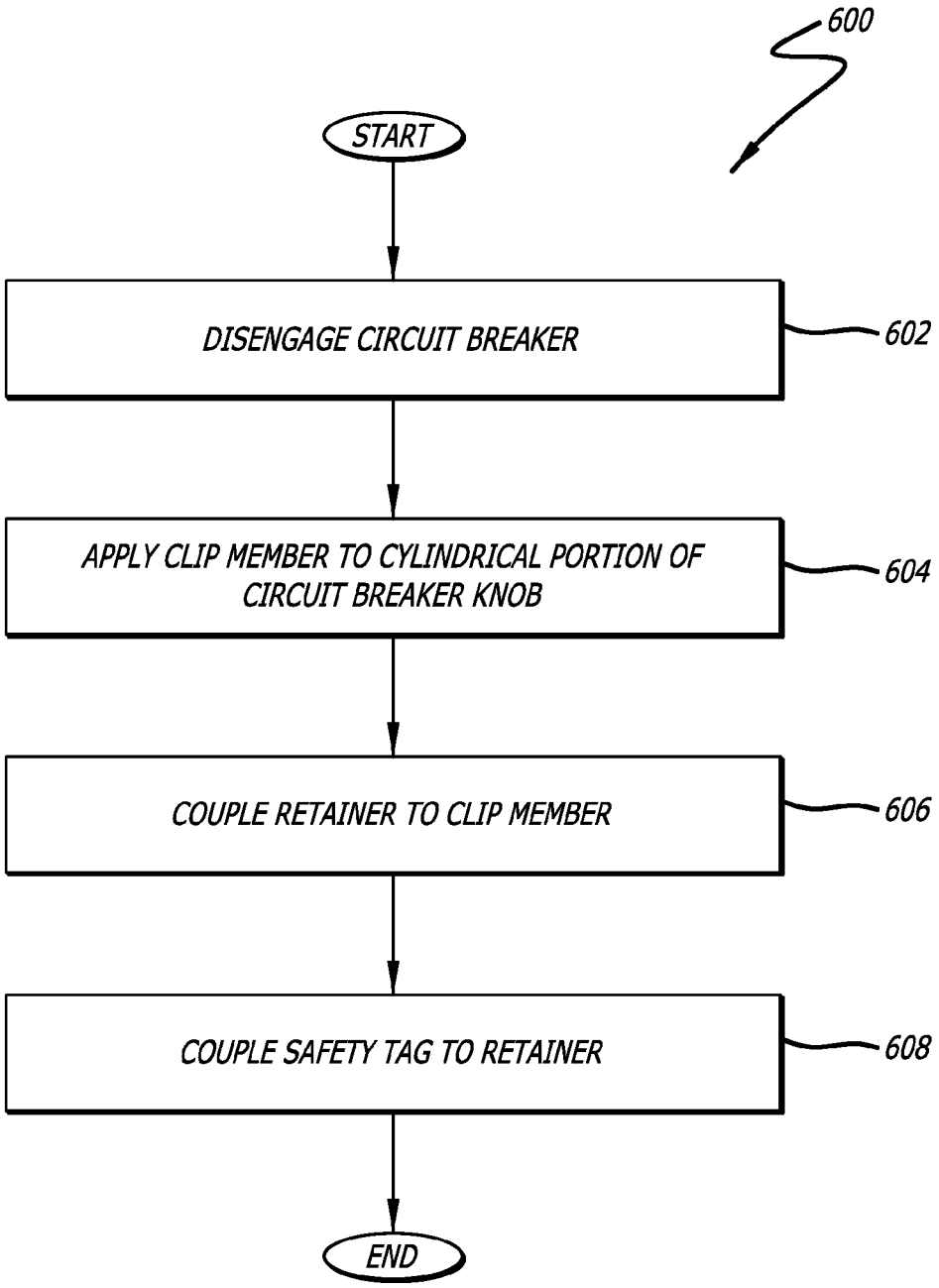
FIG. 6 illustrates a flow diagram of one example of a method for preventing actuation of a push-pull circuit breaker knob according to the present disclosure.

With reference now to FIG. 6, an exemplary method for preventing the actuation of a push-pull circuit breaker knob is illustrated in flow diagram 600. The method begins by disengaging the circuit break knob from its corresponding circuit breaker panel (step 602). Next, a clip member is applied about an actuating cylindrical portion of the circuit breaker knob (step 604). The clip member includes a generally C-shaped collar defining a cylindrical recess therein, where the clip member is configured to resiliently expand to be positioned over and receive the cylindrical portion of the circuit breaker knob.

A retainer is then coupled to the clip member to secure the clip member to the cylindrical portion of the circuit breaker knob in a manner that prohibits the clip member from being forceably removed from circuit breaker knob (step 606). In step 606, the clip member is wedged between a head portion of the circuit breaker knob and the circuit breaker panel to prevent the circuit knob from being depressed to engage the circuit breaker. Finally, a safety tag bearing safety information may be coupled to the retainer at step 608.

The safety system 200 of the present disclosure provides several advantages over existing lock-out devices. First, the lock-out device, i.e., the clip member 202, of the present disclosure is low-profile and does not protrude beyond the circuit panel 404. Thus, the clip member 202 is less likely to broken as a result of being bumped or caught by objects or article of clothing worn by a serving technician, therefore, minimizing the cost of replacing broken circuit breakers knobs.

Second, the lock-out system of the present disclosure comprises only a single part, as opposed to the multi-part construction of existing lock-out devices. Therefore, reducing the risk of FOD damage and other potential issues.

Further, different sizes of lock-out devices are typically used for high-powered and low-current circuit breakers. Lock-out systems of the present disclosure may be used in each application without varying the dimensions of the clip member or its design.

Figure 7:
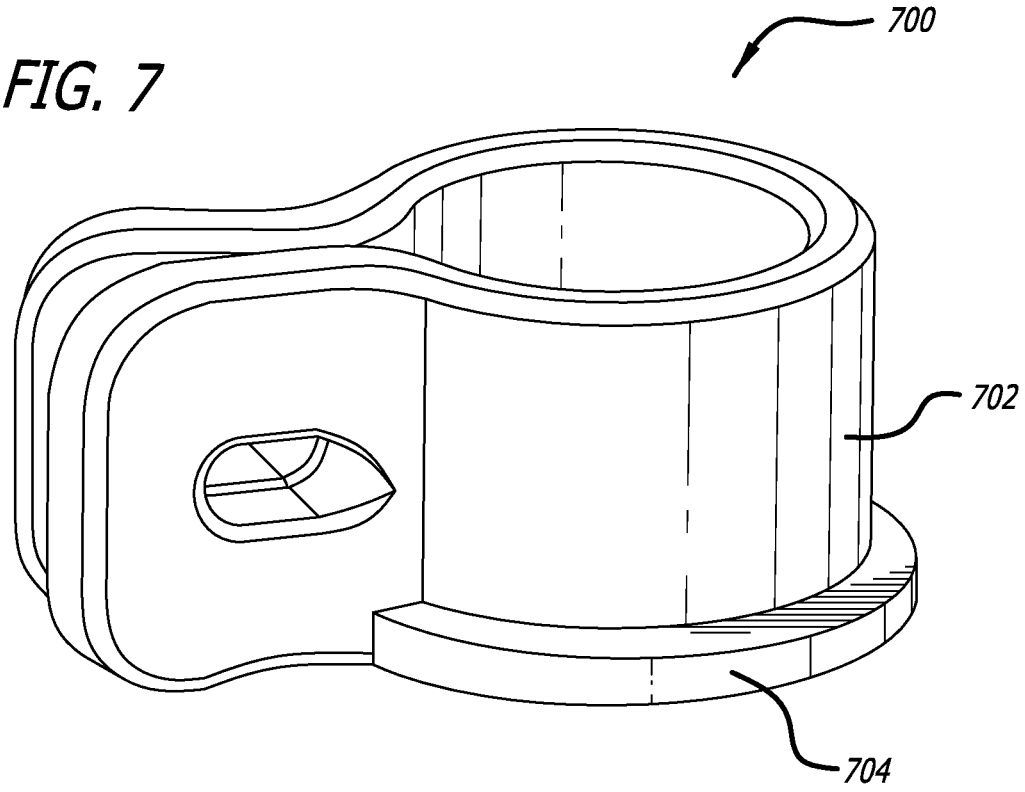
FIG. 7 is a perspective view of an example of another implementation of a clip member of the present disclosure.

FIG. 7 is a perspective view of an example of another implementation of a clip member 700 of the present disclosure. According to this implementation, the clip member 700 includes a flange 704 coupled to an under and/or top surface of the collar 702. In other implementations, the flange 704 may be coupled to both the under and top surfaces of the collar 702. The flange 704 may enhance the structural soundness of the clip member 700 and, further, enables the member to be made from lightweight and fairly inexpensive material, such as plastic. The flange 704 also provides a bearing surface for absorbing the compression loads placed on the collar 704.

While the foregoing implementations of the present disclosure are described in use in commercial aircraft structures, the present disclosure may also apply to military aircraft, spacecraft, missile systems, commercial structures, and other applications where push-pull circuit breakers are used to power equipment, circuits, or machines. In general, terms such as "attached to," "coupled to," and "configured for coupling to" and "secured to" (for example, a first component is "coupled to" or "is configured for coupling to" or is "secured to" a second component), or "communicate" (for example, a first component "communicates with" or "is in communication with" a second component) are used in this application to indicate a structural, functional, mechanical, electrical, signal, optical, magnetic, electromagnetic, ionic or fluidic relationship between two or more components (or elements, features, or the like). As such, the fact that one component is said to couple to a second component is not intended to exclude the possibility that additional components may be present between, and/or operatively associated or engaged with, the first and second components.

Although the previous description only illustrates particular examples of various implementations, the present disclosure is not limited to the foregoing illustrative examples. A person skilled in the art is aware that the disclosure as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. A system for preventing actuation of a push-pull circuit breaker knob, the system comprising:

a clip member having a generally C-shaped collar defining a cylindrical recess therein, wherein the clip member resiliently expands to be positioned over and receive a cylindrical portion of the circuit breaker knob;

first and second tabs depending from free ends of the clip member, the first and second tabs forming a restricted opening for which the cylindrical portion of the circuit breaker knob may be snapped into the recess, the first and second tabs having openings therethrough; and a retainer coupled to the first and second tabs in a manner that prohibits the first and second tabs from being urged apart and the clip member from expanding sufficiently to permit removal of the clip member from the circuit breaker knob, thereby locking the clip member in position on the push-pull circuit breaker knob and preventing the circuit breaker knob from being depressed, where each tab forms a substantially concave shape that includes a curved end integrally formed with opposite ends of the clip member, a substantially planar landing portion, and an angled free end opposite the curved end, and where the free end is angled relative to the landing portion to angular dimensions between approximately 10° to 45°.

2. The system of claim 1, where the retainer is a cable tie positioned through the openings in the first and second tabs and fastened in a loop to secure the first and second tabs to each other in a manner that prohibits the first and second tabs from being urged apart and the clip member from expanding sufficiently to permit removal of the clip member from the circuit breaker knob.

3. The system of claim 1, where the tabs have a thickness greater than the thickness of the clip member.

4. The system of claim 1, where the free ends of the tabs cooperate to form a substantially V-shaped mouth and a restricted opening into which cylindrical portion of the circuit breaker knob may be snapped.

5. The system of claim 4, where the mouth and restricted opening communicate with the recess to provide a means for urging the tabs apart and guiding the circuit breaker knob into the recess.

6. The system of claim 1, where a tag is coupled to the retainer, the tag bearing safety information.

7. A clip configured to be removably received over a cylindrical portion of a push-pull circuit breaker knob, the clip comprising:

a substantially C-shaped collar defining a cylindrical recess therein, the collar being configured to resiliently expand to be positioned over and receive the cylindrical portion of the circuit breaker knob in a manner that prevents the circuit breaker knob from being depressed to close the circuit breaker; and first and second tabs depending from free ends of the collar, the first and second tabs forming a restricted opening for which the cylindrical portion of the circuit breaker knob may be snapped in the recess, the first and second tabs each having an opening therethrough, where each tab forms a substantially concave shape that includes a curved end integrally formed with opposite ends of the collar, a substantially planar landing portion, and an angled free end opposite the curved end, and where the free end is angled relative to the landing portion to angular dimensions between approximately 10° to 45°.

8. The clip of claim 7, where the tabs have a thickness greater than the thickness of the collar.

9. The clip of claim 7, where the free ends of the tabs cooperate to form a substantially V-shaped mouth and a restricted opening into which the cylindrical portion of the circuit breaker knob may be snapped.

10. The clip of claim 9, where the mouth and restricted opening communicate with the recess to provide a means for urging the tabs apart and guiding the circuit breaker knob into the recess.

11. The clip of claim 7, where a cable tie is positioned through the openings in the first and second tabs and fastened in a loop to secure the first and second tabs to each other in a manner that prohibits the first and second tabs from being urged apart and the collar from expanding sufficiently to permit removal of the clip from the circuit breaker knob.

12. The system of claim 11, where a tag is coupled to the retainer, the tag bearing safety information.

13. A method for preventing actuation of a push-pull circuit breaker knob, the method comprising:

disengaging the circuit breaker knob from its corresponding circuit breaker panel;

applying a clip member about an actuating cylindrical portion of the circuit breaker knob, the clip member having a generally C-shaped collar defining a cylindrical recess therein, the clip member being configured to resiliently expand to be positioned over and receive the cylindrical portion; and coupling a retainer to the clip member to secure the clip member to the cylindrical portion of the circuit breaker knob in a manner that prohibits the clip member from being forceably removed from the circuit breaker knob, where coupling the retainer includes snapping the clip member in the cylindrical portion of the circuit breaker knob utilizing first and second tabs that depend from free ends of the clip member, where the first and second tabs form a restricted opening that the cylindrical portion of the circuit breaker knob may be snapped in the recess, the first and second tabs each having an opening therethrough, where each tab forms a substantially concave shape that includes a curved end integrally formed with opposite ends of the clip member, a substantially planar landing portion, and an angled free end opposite the curved end, and where the free end is angled relative to the landing portion to angular dimensions between approximately 10° to 45°.

14. The method of claim 13, where the clip member is wedged between a head portion of the circuit breaker knob and the circuit breaker panel to prevent the circuit breaker knob from being depressed to engage the circuit breaker.

15. The method of claim 13 further comprising the step of coupling an indicator to the retainer, the indicator bearing safety information.

16. The method of claim 13 further comprising the step of providing a too for severing the retainer such that the clip member may be removed from the circuit breaker knob.

* * * * *